US009019322B2

(12) United States Patent
Ding et al.

(10) Patent No.: US 9,019,322 B2
(45) Date of Patent: Apr. 28, 2015

(54) DISPLAY DRIVE WITH PERMUTATION AND SUPERPOSITION GRAY-LEVEL CONTROL

(75) Inventors: Tiefu Ding, Jilin (CN); Ruiguang Wang, Jilin (CN); Xifeng Zheng, Jilin (CN); Feng Chang, Jilin (CN)

(73) Assignee: Changchun Institute of Optics, Fine Mechanics and Physics, Chinese Academy of Sciences, Jilin (CN)

( * ) Notice: Subject to any disclaimer, the term of this patent is extended or adjusted under 35 U.S.C. 154(b) by 356 days.

(21) Appl. No.: 13/517,929

(22) PCT Filed: Dec. 21, 2010

(86) PCT No.: PCT/CN2010/002116
§ 371 (c)(1),
(2), (4) Date: Jul. 18, 2012

(87) PCT Pub. No.: WO2011/075949

PCT Pub. Date: Jun. 30, 2011

(65) Prior Publication Data

US 2012/0287178 A1 Nov. 15, 2012

(30) Foreign Application Priority Data

Dec. 22, 2009 (CN) ..... 2009 1 0218068

(51) Int. Cl.
*G09G 5/10* (2006.01)
*G09G 3/20* (2006.01)
*G09G 3/32* (2006.01)

(52) U.S. Cl.
CPC ..... *G09G 3/2007* (2013.01); *G09G 3/2018* (2013.01); *G09G 3/2077* (2013.01); *G09G 3/32* (2013.01); *G09G 2310/021* (2013.01); *G09G 2310/0213* (2013.01)

(58) Field of Classification Search
CPC ..... G09G 2310/021; G09G 2310/0213; G09G 3/2007; G09G 3/2018; G09G 3/2077; G09G 3/32
USPC ..... 345/100, 690
See application file for complete search history.

(56) References Cited

U.S. PATENT DOCUMENTS

2002/0118304 A1* 8/2002 Mandl ..... 348/671
2004/0090446 A1 5/2004 Lee et al.

(Continued)

FOREIGN PATENT DOCUMENTS

CN 1326175 A 12/2001
CN 1448901 A 10/2003

(Continued)

OTHER PUBLICATIONS

International Search Report as issued for International Patent Application No. PCT/CN2010/002116, dated Mar. 24, 2011.

*Primary Examiner* — Quan-Zhen Wang
*Assistant Examiner* — Tony Davis
(74) *Attorney, Agent, or Firm* — Pillsbury Winthrop Shaw Pittman LLP

(57) ABSTRACT

A display driver circuitry with permutation and superposition gray-level control comprises a gray-level controller. The controller may comprise a permutation and superposition adder configured to divide N-bit gray-level data G into M most significant bits, serving as a superposition reference $G_H$, and (N−M) least significant bits, serving as a superposition increment $G_L$, and to superpose superposition values $X_i$ onto $G_H$ to derive pieces of scan data $G_i$ for S scan operations; an overflow bit setting unit configured to set an overflow bit F; and an output unit configured to output the scan data $G_i$. A display driven this way has an improved refreshing frequency with the same gray-level reproduction ability as PWM-based schemes. Further, the duration of each scan operation, or scan period, is constant, resulting in convenience in software implementations. Furthermore, the pulse width representative of the gray-level value is determined by superposition of the scan operations.

24 Claims, 15 Drawing Sheets

(56) References Cited

U.S. PATENT DOCUMENTS

| | | | | |
|---|---|---|---|---|
| 2004/0257325 | A1* | 12/2004 | Inoue | 345/89 |
| 2007/0252802 | A1 | 11/2007 | Lin et al. | |
| 2008/0024856 | A1* | 1/2008 | Ishii et al. | 359/290 |
| 2009/0195493 | A1* | 8/2009 | Fujiyoshi | 345/100 |
| 2009/0195563 | A1* | 8/2009 | Xu et al. | 345/690 |
| 2010/0073406 | A1* | 3/2010 | Shishido et al. | 345/691 |

FOREIGN PATENT DOCUMENTS

| | | | |
|---|---|---|---|
| CN | 1545081 | A | 11/2004 |
| CN | 1607566 | A | 4/2005 |
| CN | 101004886 | A | 7/2007 |
| CN | 101248478 | A | 8/2008 |
| CN | 101714348 | A | 5/2010 |
| EP | 1 365 384 | A1 | 11/2003 |
| JP | 2007-264185 | A | 10/2007 |

* cited by examiner

DISPLAY DRIVE WITH PERMUTATION AND SUPERPOSITION GRAY-LEVEL CONTROL

CROSS-REFERENCE TO RELATED APPLICATION

This application claims the benefit of PCT Patent Application No. PCT/CN2010/002116, filed Dec. 21, 2010, and Chinese Publication 200910218068.6, filed on Dec. 22, 2009, both in the State Intellectual Property Office of China, both disclosures of which are incorporated herein by reference in their entirety.

TECHNICAL FIELD

The present disclosure relates to the field of gray-level control for displays, and particularly, to a display drive with permutation and superposition gray-level control.

BACKGROUND

Displays are an important type of medium through which people can receive various kinds of information. The display, as a multimedia display terminal, has a key characteristic, that is, the number of gray levels which the display can present, which is also called a gray-level reproduction ability. A greater number of gray levels which the display can present, i.e., a greater gray-level reproduction ability, cause a higher quality of displayed images, more details of the images, and better visual experiences to human eyes. The number of gray levels depends on the bit width of gray-level data. If the bit width of the gray-level data is N bits, then the display can present gray levels of $0-(2^N-1)$, $2^N$ gray levels in total. In such a case, the display is considered as having an N-bit gray-level reproduction ability. An increase in the gray-level reproduction ability by 1 bit implies a doubled number of gray levels. A Pulse Width Modulation (PWM) based scheme is a main approach to control the gray levels, wherein different gray levels are presented by adjusting a duty cycle of a pulse. Specifically, in an embodiment, a display period T can be determined based on the bit width of the gray-level data, and then the duty cycle can be modulated based on the magnitude of the gray-level data. The modulated duty cycle determines an ON duration of displaying the gray-level data by a display unit during a display period. Let the gray-level data be G, the modulated duty cycle be d, and the ON duration of the display unit be $T_{on}$. The following equation holds.

$$\begin{cases} d = \dfrac{G}{G_{max}} = \dfrac{G}{2^N - 1} \\ T_{on} = d \cdot T = \dfrac{G}{2^N - 1} \cdot T \end{cases} \quad (1)$$

Take an example where the gray-level data is 8-bit wide. When the gray-level data is varied between 0-255, the corresponding duty cycle d is modulated between 0/255-255/255. In this case, the display can present the gray levels of 0-255, 256 gray levels in total. During a display period, the gray-level data of 0 corresponds to gray level 0, and the gray-level data of 255 corresponds to gray level 255. With this scheme, an increase in the gray-level reproduction ability by 1 bit implies a doubled number of counter clocks for a duty cycle counter in a display period. If a counter clock with the same frequency is used, then the display period is doubled also. For example, 12-bit gray-level data is 4-bit wider than 8-bit gray-level data, and thus the 12-bit gray-level data will render a display period which is 16 times greater than that for the 8-bit gray-level data, given that a counter clock with the same frequency is used. As a result, the display has its refreshing frequency reduced by a factor of 1/16. Such significant reducing in the refreshing frequency causes flicker effects occur on the display, making the displayed image unsuitable to view.

Chinese Patent, published as CN 1326175 on Dec. 12, 2001, patent application no. CN 01123328 filed Apr. 21, 2001, entitled "Modulator Circuit, Image Display with the Modulator Circuit, and Modulation Method", and whose contents are hereby incorporated by reference in their entirety herein, discloses a modulator circuit with a high resolution PWM to cope with the problems caused by the increased bit width. The modulator circuit is configured to output pulse signals modulated based on values of binary codes. Specifically, the modulator circuit comprises: a selector device configured to divide a binary code from a most significant bit to a least significant bit into several divided binary codes and to select and output the divided binary codes in a preset order; a pulse output device configured to receive the divided binary codes from the selector device and to output pulse signals, with respective pulse widths and levels corresponding to the divided binary codes, in a predetermined period. In this incorporated '328 patent, the modulator circuit divides a binary code, which is intended for modulation of pulse signals, from a most significant bit to a least significant bit into several divided binary codes. The selector divided the predetermined period into sub-frame periods of different lengths corresponding to the respective divided binary codes. Pulse currents in different sub-frame periods are different in value. Take an example where a 14-bit binary code is divided into two divided binary codes, one being 10 most significant bits, and the other being 4 least significant bits, which are indicated as $B_1$ and $B_2$, respectively. The two divided binary codes have corresponding sub-frame periods with lengths of $T_1$ and $T_2$, respectively, and pulse currents of $I_1$ and $I_2$, respectively. $T_1$ and $T_2$, and $I_1$ and $I_2$ exhibit the following relationships: $T_1=2^4*T_2$, and $I_1=2^4*I_2$. Though this method can result in precise control on the gray levels, this method needs to set sub-frame periods of different lengths based on the divided binary codes, leading to more complicated works in software designing. Further, in this method the pulse currents should be adjusted based on the sub-frame periods of different lengths, leading to increased cost of drive hardware.

SUMMARY

The present disclosure aims to provide, among other features, a display driver circuitry with permutation and superposition control, which can operate at a higher refreshing frequency while presenting the same gray-level reproduction ability, without increasing hardware cost of the driver circuitry.

According to an aspect of the present disclosure, there is provided a display driver circuitry with permutation and superposition gray-level control, including a gray-level controller, the gray-level controller including: a permutation and superposition adder configured to divide N-bit gray-level data G into M most significant bits, serving as a superposition reference $G_H$, and (N−M) least significant bits, serving as a superposition increment $G_L$, and to superpose superposition values $X_i$ onto $G_H$ to derive pieces of scan data $G_i$ for S scan operations, wherein $G_i=G_H+X_i$, $$G = \sum_{i=1}^{S} G_i = S \cdot G_H + G_L,$$

$S=2^{N-M}$, $$G_L = \sum_{i=1}^{S} X_i;$$

an overflow bit setting unit configured to set an overflow bit F=0 when $G_H+X_i \leq (2^M-1)$ to indicate no overflow and then to keep $G_i=G_H+X_i$, and set F=1 when $G_H+X_i>(2^M-1)$ to indicate an overflow and then to set $G_i=2^M-1$; and an output unit configured to output the scan data $G_i$.

Here, M is variable. More specifically, M can be set based on requirements on the refreshing frequency of the display, characteristics of the display driver circuitry, and characteristics of the display itself.

To present an N-bit gray-level reproduction ability, that is, to control $2^N-1$ gray levels, the PWM-based gray-level control scheme as introduced in the background results in a display period of T and a corresponding refreshing frequency of 1/T. The driver circuitry according to the present disclosure results in a display period of T, given that the same clock frequency is used, but a corresponding refreshing frequency of SIT, because S scan operations are done in each display period. In other words, the refreshing frequency is improved by a factor of S as compared with the PWM-based gray-level control scheme, still with the same gray-level reproduction ability.

According embodiments of the present disclosure, the duration of each scan operation, i.e., the scan period, is constant, resulting in convenience in software implementations. Further, the pulse width representative of the gray-level value is determined by superposition of the S scan operations. Thus, there is no need to modulate the pulse current in the gray-level control, resulting in reduced hardware cost of the driver circuitry.

According to an embodiment, the gray-level controller may further include a nonlinear transform unit configured to conduct nonlinear transform on K-bit original data D to derive the N-bit gray-level data G according to equation (2):

$$G=C \cdot D^r \quad (2)$$

where C denotes a proportional constant and r denotes a nonlinear transform coefficient, $2.2 \leq r \leq 2.9$ and C=1.

According to this embodiment, the image information (i.e., the original data) is subjected to the nonlinear transform, so as to increase the bit width of the gray-level data. As a result, it is possible to enhance the gray-level reproduction ability of the display, and thus to give a higher quality of displayed images, more details of the images, and better visual experiences to human eyes.

The nonlinear transform unit may have a nonlinear transform look-up table (LUT) stored therein, which stores results of the nonlinear transform on all possible pieces of the K-bit original data, i.e., $0\text{-}2^K-1$, in a one-to-one correspondence sequentially in addresses $0\text{-}2^K-1$. Here, K and N are not fixed in value. Specifically, in accordance with an embodiment, the value of K depends on the bit width of the data source, and the value of N depends on the gray-level reproduction ability to be achieved.

With the nonlinear transform LUT, the nonlinear transform on the original data can be done by addressing the LUT. Therefore, the nonlinear transform can be done in a convenient way, resulting in reduced computing time and hardware resources.

Other features and advantages of the present disclosure will become apparent from the following detailed description, the accompanying drawings, and the appended claims.

DETAILED DESCRIPTION

Throughout this disclosure it should be understood that a display can present number of gray levels in the form of pixels, which may be assembled, scanned, and/or processed in rows and columns. The number of gray levels may depend on the bit width of gray-level data (i.e., the bits of the pixels).

Figure 1:
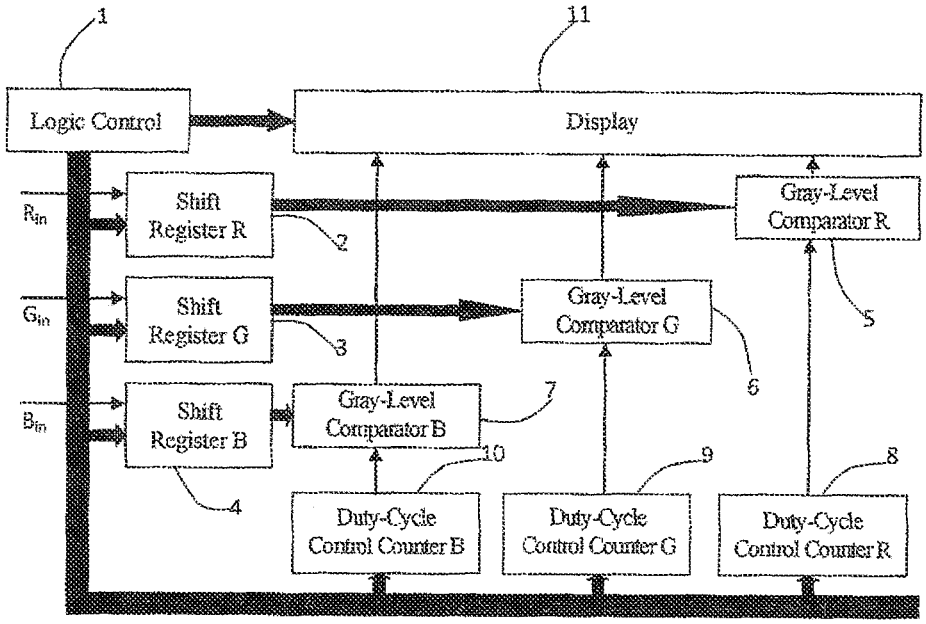
FIG. 1 is a block diagram schematically showing a display driver circuitry according to a Pulse Width Modulation based gray-level control scheme in the relevant art.

The pulse-width-modulation (PWM) based gray-level control technology as described in the background can be implemented as shown in FIG. 1. A logic control unit 1 controls shift clocks for shift registers 2, 3, 4 to transfer gray-level data for respective display units to proper positions. When the gray-level data reach the designated positions, the logic control unit 1 latches the gray-level data for the respective units into respective gray-level comparators 5, 6, 7. By a reset signal, all the display units are turned ON, and duty-cycle control counters 8, 9, 10 with respect to primary colors of red, green, and blue for the respective display units start to count by being driven by a counter clock. When the duty-cycle control counter 8 and the gray-level comparator 5 have identical values, the primary color of red is turned off in the display unit 11. When the duty-cycle control counter 9 and the gray-level comparator 6 have identical values, the primary color of green is turned off in the display unit 11. When the duty-cycle control counter 10 and the gray-level comparator 7 have identical values, the primary color of blue is turned off in the display unit 11. Thus, the gray-level control for the respective display units during a display period T is completed. Upon the end of one period, all the counters are reset to zero for the next period. It is to be noted that if the gray-level data is equal to 0, then the display unit is kept off, and the gray-level comparators 5, 6, 7 and the duty-cycle control counters 8, 9, 10 need not to operate.

Figure 2:
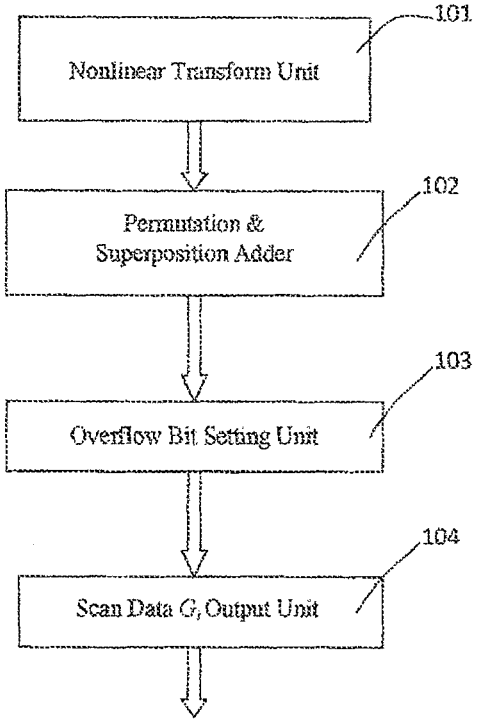
FIG. 2 is a block diagram schematically showing a gray-level controller of a display driver circuitry with permutation and superposition gray-level control according to an embodiment of the present disclosure.

As, shown in FIG. 2, according to an embodiment, a display driver circuitry with permutation and superposition gray-level control comprises a gray-level controller including a nonlinear transform unit 101, a permutation and superposition adder 102, an overflow bit setting unit 103 configured to set an overflow bit F, and an output unit 104 configured to output scan data $G_i$.

According to an embodiment of the present disclosure, it is possible to provide a display with an N-bit gray-level reproduction ability while having a refreshing frequency which otherwise would occur in displaying Mbit gray-level data (M<N). In this way, it is possible to achieve the N-bit gray-level reproduction ability at the refreshing frequency which is $2^{N-M}$ times that in the PWM based gray-level control scheme as mentioned in the background. In principle, the gray-level data is divided into M most significant bits and (N−M) least significant bits, and is outputted in a display period by $2^{N-M}$ scan operations. Due to the control of the gray-level data, $2^N$ gray levels can be presented on the display in each display period, that is, the N-bit gray-level reproduction ability is achieved. Further, $2^{N-M}$ scan operations are done in each display period, resulting in the refreshing frequency enhanced by a factor of $2^{N-M}$.

To improve the gray-level reproduction ability of the display, image information can be subjected to nonlinear transform firstly, to increase the bit width of the gray-level data. Here, the image information before being subjected to the nonlinear transform is called original data D. The nonlinear transform can be performed on the original data D as shown in equation (2), where C denotes a proportional constant and r denotes a nonlinear transform coefficient, which can be determined base on visual characteristics of human eyes, characteristics of the original data, and display characteristics of the display. Generally, r lies between about 2.2 and about 2.9. For example, r assumes 2.2 for LCDs, and assumes 2.3 or 2.5 for LED displays, or even 2.9 for some LED displays. The proportional constant C generally assumes 1.

$$G=C\cdot D^r \tag{2}$$

During the display operation, if the nonlinear transform such as that shown in equation (2) is done on each piece of the original data D, it will be time and resource consuming. To do the nonlinear transform on the original data in a more convenient and rapid way, following operations can be performed. Let the bit width of the original data be K bits. Results of the nonlinear transform on all possible pieces of original data, i.e., $0\text{-}2^K-1$, can be calculated in advance by some mathematic software (e.g., Matlab). These results can be stored in a one-to-one correspondence sequentially in addresses $0\text{-}2^K-1$, resulting in a nonlinear transform look-up table (LUT) which can be stored in the nonlinear transform unit 101. Then, during the display operation, the nonlinear transform on the original data can be done by addressing the nonlinear transform LUT, without repeating the calculation shown in equation (2). Assume the bit width of the gray-level data resulting from the nonlinear transform is N bits. Then, the nonlinear transform LUT may have a size of $2^K$*N bits.

The nonlinear transform on the K-bit original data D results in the N-bit gray-level data G.

The N-bit gray-level data G is divided into M most significant bits and (N−M) least significant bits, and is processed by the permutation and superposition adder 102 to derive pieces of M-bit scan data $G_1, G_2, \ldots, G_{S-1}, G_S$. The permutation and superposition adder can process the gray-level data as follows. Specifically, in accordance with an embodiment, the permutation and superposition adder may be configured to take the M most significant bits of the gray-level data as a superposition reference, indicated as $G_H$, and take the (N−M) least significant bits of the gray-level data as a superposition increment, indicated as $G_L$. The relationship among G, $G_H$, and $G_L$ can be expressed as equation (3).

$$G=2^{(N-M)}\cdot G_H+G_L \tag{3}$$

A display period takes $2^{N-1}$ clock cycles. Let the number of scan operations done in a display period be S. Then, the following equation holds.

$$S=2^{N-M} \tag{4}$$

Superposition a superposition value $X_i$ onto $G_H$ results in the scan data $G_i=G_H+X_i$, where $$G_i=\sum_{i=1}^{S} X_i.$$

The superposition value $X_i$ in the i-th scan operation can be determined based on selected permutation and superposition patterns.

For example, if $G_L=0$, then $$G_i=G_H \quad i=1, 2, \ldots S \tag{5}$$

If $G_L=1$, then $$\begin{cases} G_1 = G_H + 1 \\ G_i = G_H \end{cases} \quad i = 2, 3, \ldots, S \tag{6}$$

If $G_L$=2, then $$\begin{cases} G_1 = G_H + 2 \\ G_i = G_H \end{cases} \quad i = 2, 3, \ldots, S \tag{7}$$

or otherwise, $$\begin{cases} G_1 = G_H + 1 \\ G_2 = G_H + 1 \\ G_i = G_H \end{cases} \quad i = 3, 4, \ldots, S \tag{8}$$

If $G_L$=3, then $$\begin{cases} G_1 = G_H + 3 \\ G_i = G_H \end{cases} \quad i = 2, 3, \ldots, S \tag{9}$$

or otherwise, $$\begin{cases} G_1 = G_H + 1 \\ G_2 = G_H + 2 \\ G_i = G_H \end{cases} \quad i = 3, 4, \ldots, S \tag{10}$$

or otherwise, $$\begin{cases} G_1 = G_H + 1 \\ G_2 = G_H + 1 \\ G_3 = G_H + 1 \\ G_i = G_H \end{cases} \quad i = 4, 5, \ldots, S \tag{11}$$

If $G_L$=4, then $$\begin{cases} G_1 = G_H + 4 \\ G_i = G_H \end{cases} \quad i = 2, 3, \ldots, S \tag{12}$$

or otherwise, $$\begin{cases} G_1 = G_H + 1 \\ G_2 = G_H + 3 \\ G_i = G_H \end{cases} \quad i = 3, 4, \ldots, S \tag{13}$$

or otherwise, $$\begin{cases} G_1 = G_H + 2 \\ G_2 = G_H + 2 \\ G_i = G_H \end{cases} \quad i = 3, 4, \ldots, S \tag{14}$$

or otherwise, $$\begin{cases} G_1 = G_H + 1 \\ G_2 = G_H + 1 \\ G_3 = G_H + 2 \\ G_i = G_H \end{cases} \quad i = 4, 5, \ldots, S \tag{15}$$

or otherwise, $$\begin{cases} G_1 = G_H + 1 \\ G_2 = G_H + 1 \\ G_3 = G_H + 1 \\ G_4 = G_H + 1 \\ G_i = G_H \end{cases} \quad i = 5, 6, \ldots, S \tag{16}$$

For other $G_L$'s, the above operations can be done in the same way, to derive the scan data used in the S scan operations. Thus, G, $G_H$, $G_L$, and $G_1, G_2, \ldots, G_{S-1}, G_S$ can exhibit the following relationship as shown in equation (17).

$$G = \sum_{i=1}^{S} G_i = S \cdot G_H + G_L \tag{17}$$

The superposition pattern as that shown in equation (5) is called 0-order superposition, which is done only if $G_L$=0. The superposition pattern as that shown in equation (6), (7), (9), or (16), where $G_L$ is superposed onto one piece of scan data, is called 1-order superposition. The superposition pattern as that shown in equation (8), (10), (13), or (14), where $G_L$ has its fractions superposed onto two pieces of scan data respectively, is called 2-order superposition. The superposition pattern as that shown in equation (11) or (15), where $G_L$ has its fractions superposed onto three pieces of scan data respectively, is called 3-order superposition. The superposition pattern as that shown in equation (16), where $G_L$ has its fractions superposed onto four pieces of scan data respectively, is called 4-order superposition. All the superposition patterns can be termed in the same way. It can be seen that the highest order superposition pattern is $G_L$-order superposition.

Because S scan operations are done per display period, each scan operation takes T/S. From equation (1), it can be derived that the scan data $G_1, G_2, \ldots, G_{S-1}, G_S$ in the S scan operations have duty cycles of $$\frac{G_1}{2^M - 1}, \frac{G_2}{2^M - 1}, L, \frac{G_{S-1}}{2^M - 1}, \frac{G_S}{2^M - 1},$$

respectively. Thus, a display unit for which the gray-level data G is provided is turned ON per display period for an ON duration $T'_{on}$ $$T'_{on} = \sum_{i=1}^{S} \frac{G_i}{2^M - 1} \cdot \frac{T}{S} \tag{18}$$

Substitution of equations (3), (4), and (17) into equation (18) reaches $$T'_{on} = \frac{G}{2^N - 2^{N-M}} \cdot T \tag{19}$$

Thus, according to this embodiment, it is possible to present duty cycles of $$\frac{0}{2^N - 2^{N-M}} \sim \frac{2^N - 2^{N-M}}{2^N - 2^{N-M}},$$

that is, $(2^N - 2^{N-M} + 1)$ duty cycles in total, instead of expected duty cycles of $$\frac{0}{2^N - 1} \sim \frac{2^N - 1}{2^N - 1},$$

that is, $2^N$ duty cycles in total. In other words, the actually achieved gray levels are less than the expected gray levels to achieve the N-bit gray-level reproduction ability by $(2^{N-M} - 1)$. This is caused by the possibility of $G_H + X_i > (2^M - 1)$ during the superposition operation in the case where $G_H > (2^M - 1 - X_i)$. In this case, the permutation and superposition adder overflows. However, in accordance with an embodiment, the lost gray levels are only a relatively small fraction with respect to all the $2^N$ gray levels. For example, if N=12 and M=10, then the number of the expected gray levels are 4096, while the number of the actually achieved gray levels are 4093. That is, only 3 gray levels are lost. This has little impact on the gray-level reproduction ability of the display.

Here, the adder is called "permutation and superposition adder" for the following reasons. First, the order in which the pieces of scan data $G_1, G_2, \ldots, G_{S-1}, G_S$ are outputted in the 5 scan operations is not fixed. There may be a variety of permutation patterns. For example, with respect to 4 scan operations per display period, Table 1 shows twenty four (24) permutation patterns of the scan data outputted in the scan operations. Second, the scan data $G_1, G_2, G_{S-1}, G_S$ can be derived in a variety of superposition patterns. For example, again with respect to 4 scan operations per display period, there can be 4 superposition patterns, i.e., 0-order superposition, 1-order superposition, 2-order superposition, and 3-order superposition, depending on $G_L$. The gray level presented on the display is the result of superposition of the S pieces of scan data, regardless of which superposition pattern is adopted to derive the scan data and which permutation pattern is adopted to output the scan data.

TABLE 1

| | | | | | |
|---|---|---|---|---|---|
| $G_1$ | $G_1$ | $G_1$ | $G_1$ | $G_1$ | $G_1$ |
| $G_2$ | $G_2$ | $G_3$ | $G_3$ | $G_4$ | $G_4$ |
| $G_3$ | $G_4$ | $G_2$ | $G_4$ | $G_2$ | $G_3$ |
| $G_4$ | $G_3$ | $G_4$ | $G_2$ | $G_3$ | $G_2$ |
| $G_2$ | $G_2$ | $G_2$ | $G_2$ | $G_2$ | $G_2$ |
| $G_1$ | $G_1$ | $G_3$ | $G_3$ | $G_4$ | $G_4$ |
| $G_3$ | $G_4$ | $G_1$ | $G_4$ | $G_1$ | $G_3$ |
| $G_4$ | $G_3$ | $G_4$ | $G_1$ | $G_3$ | $G_1$ |
| $G_3$ | $G_3$ | $G_3$ | $G_3$ | $G_3$ | $G_3$ |
| $G_1$ | $G_1$ | $G_2$ | $G_2$ | $G_4$ | $G_4$ |
| $G_2$ | $G_4$ | $G_1$ | $G_4$ | $G_1$ | $G_2$ |
| $G_4$ | $G_2$ | $G_4$ | $G_1$ | $G_2$ | $G_1$ |
| $G_4$ | $G_4$ | $G_4$ | $G_4$ | $G_4$ | $G_4$ |
| $G_1$ | $G_1$ | $G_2$ | $G_2$ | $G_3$ | $G_3$ |
| $G_2$ | $G_3$ | $G_1$ | $G_3$ | $G_1$ | $G_2$ |
| $G_3$ | $G_2$ | $G_3$ | $G_1$ | $G_2$ | $G_1$ |

Figure 3:
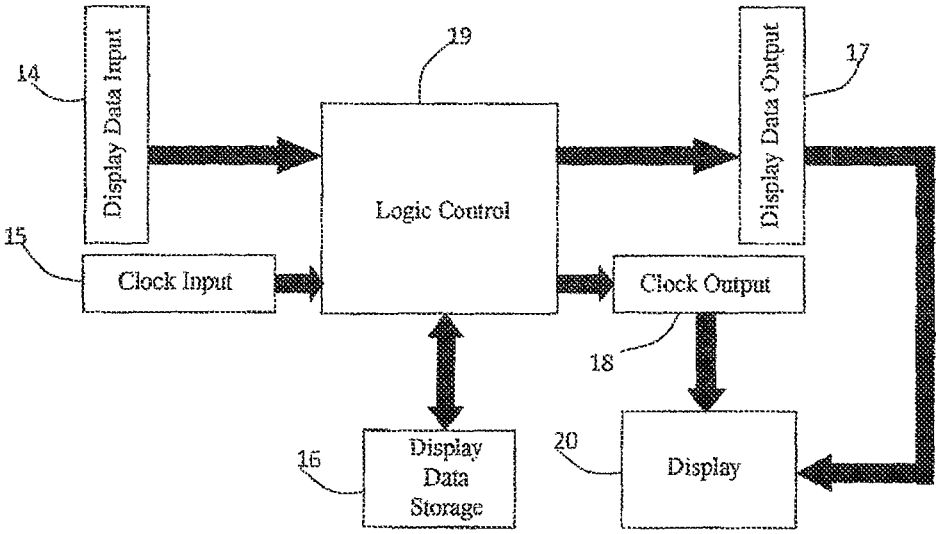
FIG. 3 is a block diagram schematically showing a display driver circuitry with permutation and superposition gray-level control according to an embodiment of the present disclosure.
Figure 4:
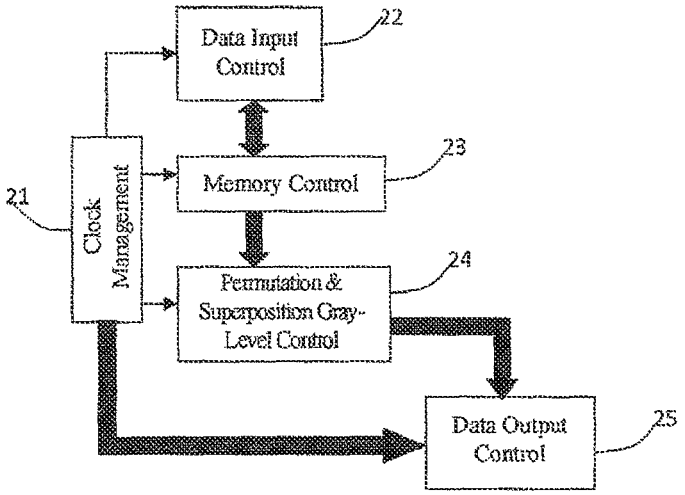
FIG. 4 is a block diagram schematically showing a logic control unit according to an embodiment of the present disclosure.

As shown in FIG. 3, according to an embodiment, a display driver circuitry with permutation and superposition gray-level control comprises a display data input unit 14, a clock input unit 15, a display data storage unit 16, a display data output unit 17, a clock output unit 18, and a logic control unit 19. The logic control unit 19 can be a main controller for this circuitry. The logic control unit 19 may comprise 6 modules as shown in FIG. 4, i.e., a clock management module 21, a data input control module 22, a memory control module 23, a permutation and superposition gray-level control module 24, and a data output control module 25. The display data input unit 14 may comprise a series interface or a network interface. The clock input unit 15 may comprise a crystal oscillator. The display data storage unit 16 may comprise a SDRAM or DDRAM memory. The display data output unit 17 may comprise a flat cable. The clock output unit 18 may also comprise a flat cable. The logic control unit 19 may be implemented by, but not limited to, FPGA or ASIC.

The clock management module 21 can be configured to generate clocks for the respective modules based on a system clock, and also to synchronize and coordinate operations of the respective modules. The data input control module 22 can be configured to convert inputted serial display data into parallel original data. The memory control module 23 can be configured to wire and read the original data to and from the memory. The permutation and superposition gray-level control module 24 can be configured to derive scan data based on the permutation and superposition control. The data output control module 25 can be configured to convert the scan data to be outputted into data in a format compatible with a display 20.

According to an embodiment, the gray-level controller can be implemented by software programmed in the logic control unit of the display driver circuitry (as, e.g., the permutation and superposition gray-level control module shown in FIG. 4).

Figure 5:
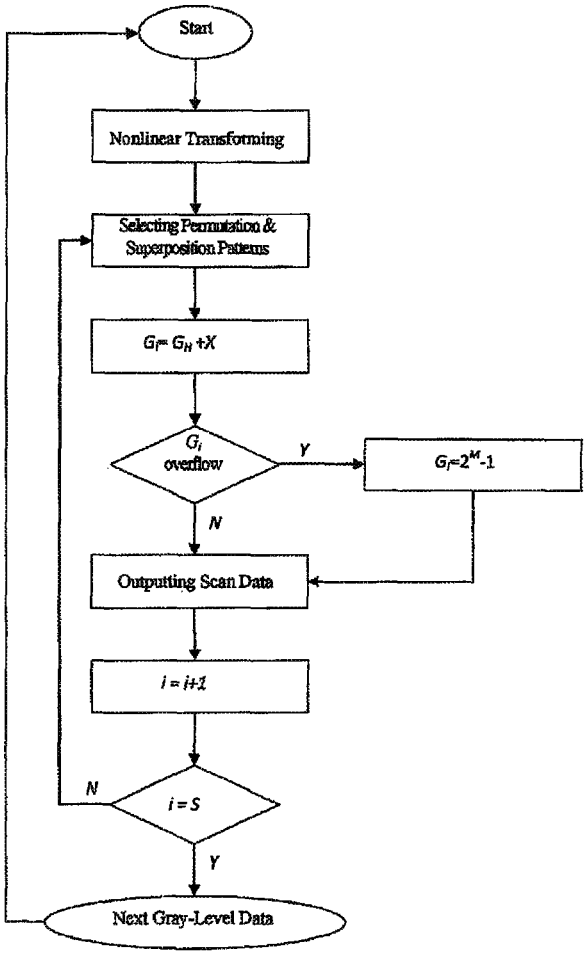
FIG. 5 is a flow chart schematically showing a process of permutation and superposition gray-level control according to an embodiment of the present disclosure.

As shown in FIG. 5, the permutation and superposition gray-level control module can be configured to execute a flow comprising:

a. reading original data D from the memory;

b. conducting nonlinear transform on the original data D to derive gray-level data G;

c. selecting a permutation pattern and a superposition pattern for the gray-level data;

d. determining a superposition value $X_i$ in the i-th scan operation based on the selected permutation pattern and superposition pattern, to perform superposition of the gray-level data;

e. setting an overflow bit F, where F=0 indicates there is no overflow, and F=1 indicates overflow occurs, in which case the result of the permutation and superposition adder is set to be $2^M-1$;

f. outputting the scan data: and g. counting the number of the scan operations, where if the number i is equal to S, then one piece of gray-level data is completed and the process proceeds to the next piece of gray-level data.

In the operation of c, the selection of the superposition pattern to derive the scan data and the permutation pattern to output the scan data can be set by some parameters. For convenience of setting of the parameters, the flow can be further optimized. For example, the permutation pattern of the scan data can be optimized. Here, an example where $G_L$=3, S=4, and the superposition pattern is 3-order superposition is discussed. Then, the derived scan data can be those shown in equation (20).

$$\begin{cases} G_1 = G_H + 1 \\ G_2 = G_H + 1 \\ G_3 = G_H + 1 \\ G_4 = G_H \end{cases} \tag{20}$$

In this case, $G_1$, $G_2$, and $G_3$ are equal to each other. As a result, the 24 permutation patterns shown in Table 1 are simplified into 4 permutation patterns of $G_1G_2G_3G_4$, $G_1G_2G_4G_3$, $G_1G_4G_2G_3$, and $G_4G_1G_2G_3$, any of the remaining patterns is same as one of those 4 permutation patterns. Thus, there are only 4 permutation patterns for the scan data. According to an embodiment, the same permutation patterns are simplified.

The above embodiments are not intended to limit the display driver circuitry with permutation and superposition gray-level control. All devices, systems, products, manufactures, articles, and processes to control the gray level in some permutation and superposition patterns fall into the scope of the present disclosure.

EXAMPLE 1

Figure 6:
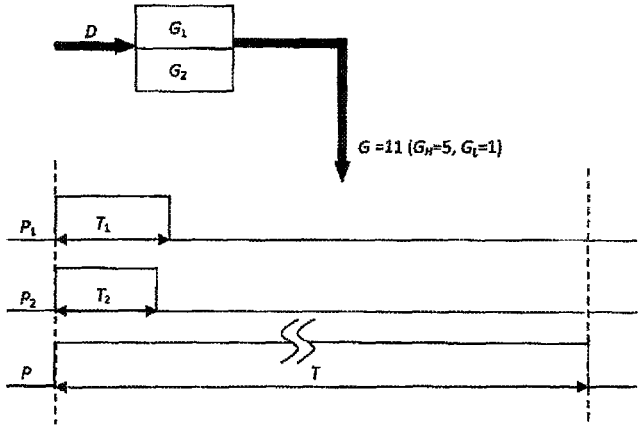
FIG. 6 is a schematic view showing a display situation of a display unit in each scan operation during a display period in a case where K=8, M=11, N=12, G=11, with a superposition pattern of 1-order superposition, and a permutation pattern of $G_1G_2$.
Figure 7:
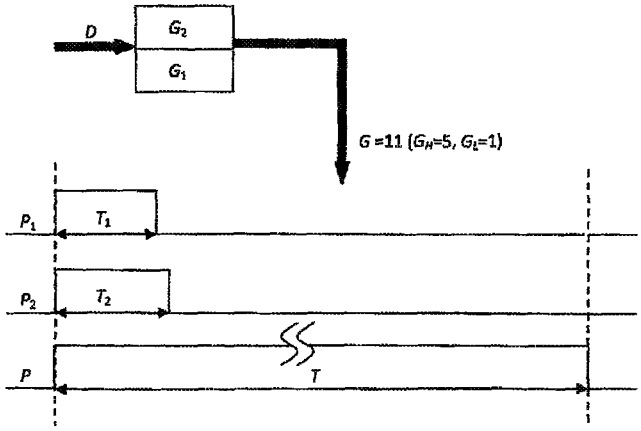
FIG. 7 is a schematic view showing a display situation of a display unit in each scan operation during a display period in a case where K=8, M=11, N=12, G=11, with a superposition pattern of 1-order superposition, and a permutation pattern of $G_2G_1$.
Figure 8:
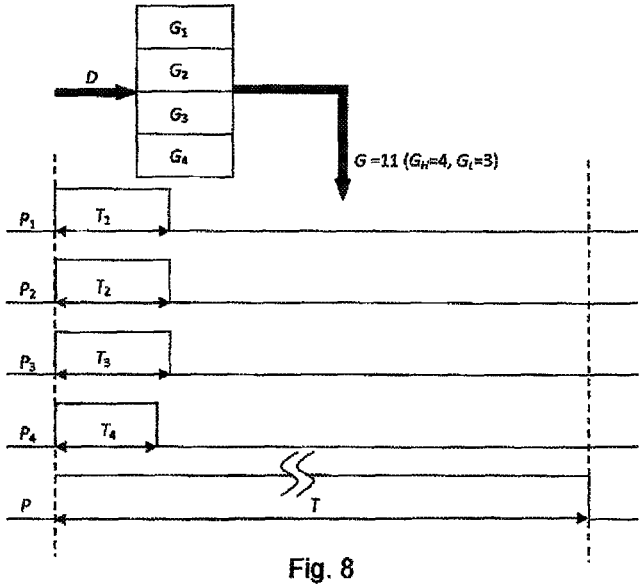
FIG. 8 is a schematic view showing a display situation of a display unit in each scan operation during a display period in a case where K=8, M=10, N=12, G=11, with a superposition pattern of 3-order superposition, and a permutation pattern of $G_1G_2G_3G_4$.

Take an LED display as an example, and let K=8, N=12, and M=11. In this case, the number of scan operations $S=2^{(N-M)}=2$, $G_H$=G[11:1], $G_L$=G[0]. Table 2 shows superposition patterns in the 2 scan operations and the superposition results. FIGS. 6 and 7 show display situations of a display unit in each of the scan operations during a display period in a case where G=11, i.e., $G_H$=5 and $G_L$=1, the superposition pattern is 1-order superposition, and the permutation pattern is $G_1G_2$, and in a case where G=11, i.e., $G_H$=5 and $G_L$=1, the superposition pattern is 1-order superposition, and the permutation pattern is $G_2G_1$, respectively. Here, P denotes the display period, that is, T. Thus, each scan operation takes T/2. $P_1$ and $P_2$ denote the 2 scan operations, respectively, $T_1$ and $T_2$ denote the ON durations of the display unit in the 2 scan operations, respectively. In the situation shown in FIG. 6, $$T_1 = \frac{6}{2^{11}-1} \times \frac{T}{2} \text{ and } T_2 = \frac{5}{2^{11}-1} \times \frac{T}{2}.$$

In the situation shown in FIG. 7, $$T_1 = \frac{5}{2^{11}-1} \times \frac{T}{2} \text{ and } T_2 = \frac{6}{2^{11}-1} \times \frac{T}{2}.$$

In this case, the refreshing frequency of the display is $$\frac{2}{T},$$

which improved by a factor of 2 as compared with the refreshing frequency in the PWM based gray-level control scheme.

TABLE 2

| Increment | Superposition Pattern | Superposition Result |
|---|---|---|
| $G_L = 0$ | 0-order superposition | $\begin{cases} G_1 = G_H \\ G_2 = G_H \end{cases}$ |
| $G_L = 1$ | 1-order superposition | $\begin{cases} G_1 = G_H + 1 \\ G_2 = G_H \end{cases}$ |

EXAMPLE 2

Take an LED display as an example, and let K=8, N=12, and M=10. In this case, the number of scan operations $S=2^{(N-M)}=4$, $G_H$=G[11:2], $G_L$=G[1:0]. Table 3 shows superposition patterns in the 4 scan operations and the superposition results. FIGS. 8, 9, 10 and 11 show display situations of a display unit in each of the scan operations during a display period in a case where G=11, i.e., $G_H$=2 and $G_L$=3, the superposition pattern is 3-order superposition, and the permutation pattern is $G_1G_2G_3G_4$, in a case where G=11, i.e., $G_H$=2 and $G_L$=3, the superposition pattern is 3-order superposition, and the permutation pattern is $G_4G_3G_2G_1$, in a case where G=11, i.e., $G_H$=2 and $G_L$=3, the superposition pattern is 1-order superposition, and the permutation pattern is $G_1G_2G_3G_4$, and in a case where G=11, i.e., $G_H$=2 and $G_L$=3, the superposition pattern is 1-order superposition, and the permutation pattern is $G_4G_3G_2G_1$, respectively. Here, P denotes the display period, that is, T. Thus, each scan operation takes T/4. $P_1$, $P_2$, $P_3$ and $P_4$ denote the 4 scan operations, respectively. $T_1$, $T_2$, $T_3$, and $T_4$ denote the ON durations of the display unit in the 4 scan operations, respectively. In the situation shown in FIG. 8, $$T_1 = \frac{3}{2^{10}-1} \times \frac{T}{4}, T_2 = \frac{3}{2^{10}-1} \times \frac{T}{4},$$

$$T_3 = \frac{3}{2^{10}-1} \times \frac{T}{4}, \text{ and } T_4 = \frac{2}{2^{10}-1} \times \frac{T}{4}.$$

Figure 9:
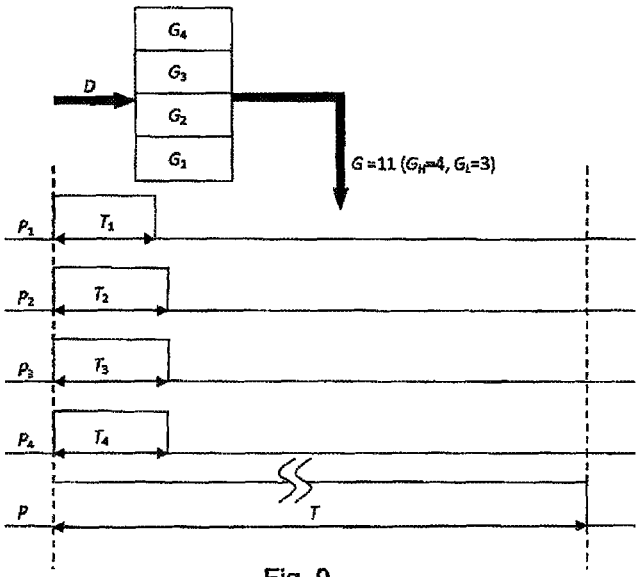
FIG. 9 is a schematic view showing a display situation of a display unit in each scan operation during a display period in a case where K=8, M=10, N=12, G=11, with a superposition pattern of 3-order superposition, and a permutation pattern of $G_4G_3G_2G_1$.

In the situation shown in FIG. 9, $$T_1 = \frac{2}{2^{10}-1} \times \frac{T}{4},\ T_2 = \frac{3}{2^{10}-1} \times \frac{T}{4},$$
$$T_3 = \frac{3}{2^{10}-1} \times \frac{T}{4},\ \text{and}\ T_4 = \frac{3}{2^{10}-1} \times \frac{T}{4}.$$

Figure 10:
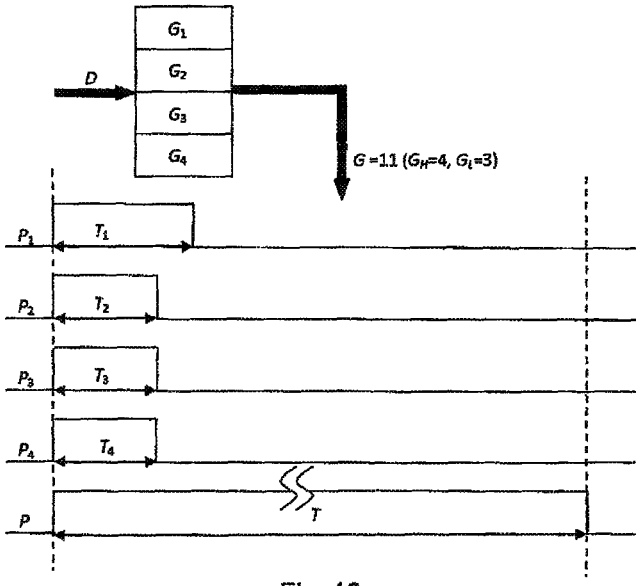
FIG. 10 is a schematic view showing a display situation of a display unit in each scan operation during a display period in a case where K=8, M=10, N=12, G=11, with a superposition pattern of 1-order superposition, and a permutation pattern of $G_1G_2G_3G_4$.

In the situation shown in FIG. 10, $$T_1 = \frac{5}{2^{10}-1} \times \frac{T}{4},\ T_2 = \frac{2}{2^{10}-1} \times \frac{T}{4},$$
$$T_3 = \frac{2}{2^{10}-1} \times \frac{T}{4},\ \text{and}\ T_4 = \frac{2}{2^{10}-1} \times \frac{T}{4}.$$

Figure 11:
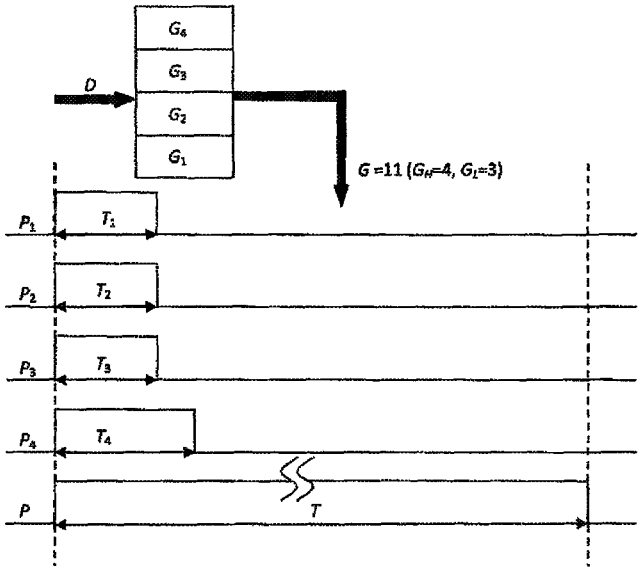
FIG. 11 is a schematic view showing a display situation of a display unit in each scan operation during a display period in a case where K=8, M=10, N=12, G=11, with a superposition pattern of 1-order superposition, and a permutation pattern of $G_4G_3G_2G_1$.

In the situation shown in FIG. 11, $$T_1 = \frac{2}{2^{10}-1} \times \frac{T}{4},\ T_2 = \frac{2}{2^{10}-1} \times \frac{T}{4},$$
$$T_3 = \frac{2}{2^{10}-1} \times \frac{T}{4},\ \text{and}\ T_4 = \frac{5}{2^{10}-1} \times \frac{T}{4}.$$

In this case, the refreshing frequency of the display is $$\frac{4}{T},$$

which is improved by a factor of 4 as compared with the refreshing frequency in the PWM based gray-level control scheme.

TABLE 3

| Increment | Superposition Pattern | Superposition Result |
|---|---|---|
| $G_L = 0$ | 0-order superposition | $\begin{cases} G_1 = G_H \\ G_2 = G_H \\ G_3 = G_H \\ G_4 = G_H \end{cases}$ |
| $G_L = 1$ | 1-order superposition | $\begin{cases} G_1 = G_H + 1 \\ G_2 = G_H \\ G_3 = G_H \\ G_4 = G_H \end{cases}$ |
| $G_L = 2$ | 1-order superposition | $\begin{cases} G_1 = G_H + 2 \\ G_2 = G_H \\ G_3 = G_H \\ G_4 = G_H \end{cases}$ |
| | 2-order superposition | $\begin{cases} G_1 = G_H + 1 \\ G_2 = G_H + 1 \\ G_3 = G_H \\ G_4 = G_H \end{cases}$ |
| $G_L = 3$ | 1-order superposition | $\begin{cases} G_1 = G_H + 3 \\ G_2 = G_H \\ G_3 = G_H \\ G_4 = G_H \end{cases}$ |

TABLE 3-continued

| Increment | Superposition Pattern | Superposition Result |
|---|---|---|
| | 2-order superposition | $\begin{cases} G_1 = G_H + 1 \\ G_2 = G_H + 2 \\ G_3 = G_H \\ G_4 = G_H \end{cases}$ |
| | 3-order superposition | $\begin{cases} G_1 = G_H + 1 \\ G_2 = G_H + 1 \\ G_3 = G_H + 1 \\ G_4 = G_H \end{cases}$ |

EXAMPLE 3

Figure 12A:
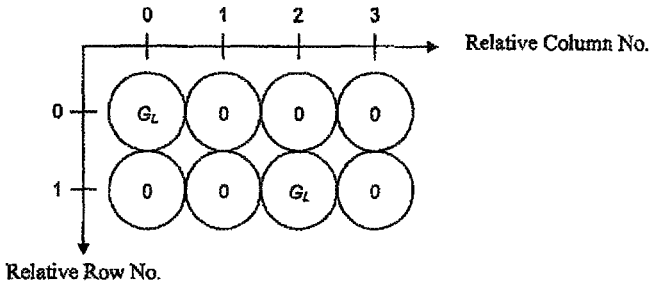
FIG. 12 is a schematic view showing a further superposition pattern of scan data for 2*4 pixels in 4 scan operations in a case where K=8, M=10, N=12, G=11.
Figure 12B:
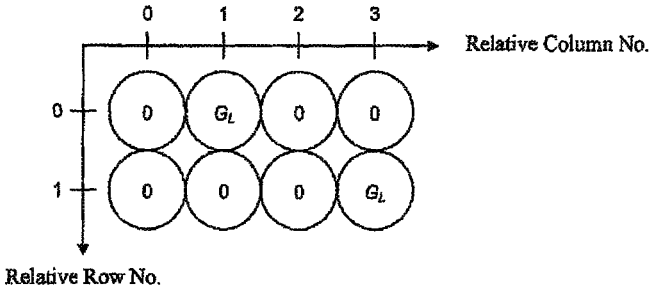
Figure 12C:
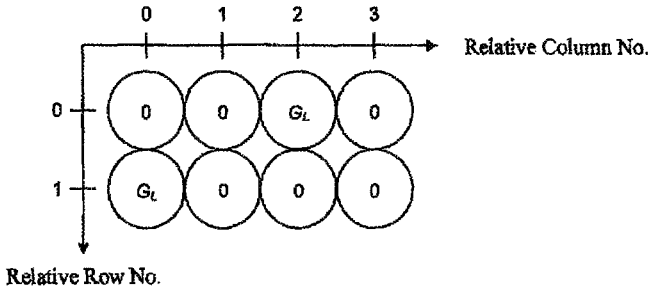
Figure 12D:
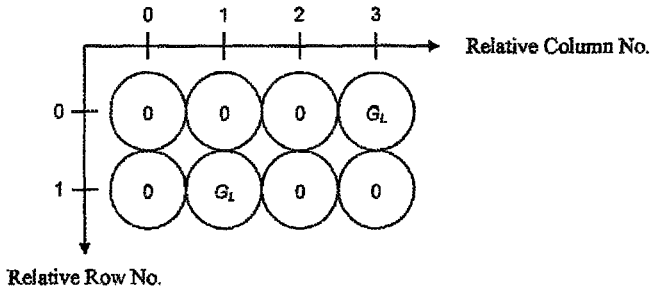
Figure 13A:
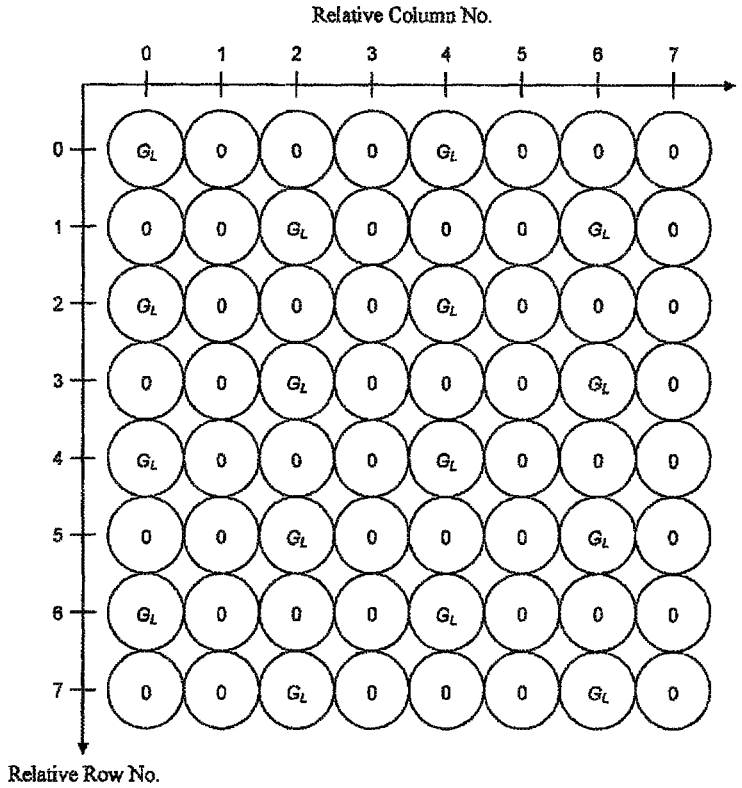
FIG. 13 is a schematic view showing a further superposition pattern of scan data for 8*8 pixels in 4 scan operations in a case where K=8, M=10, N=12, G=11.
Figure 13B:
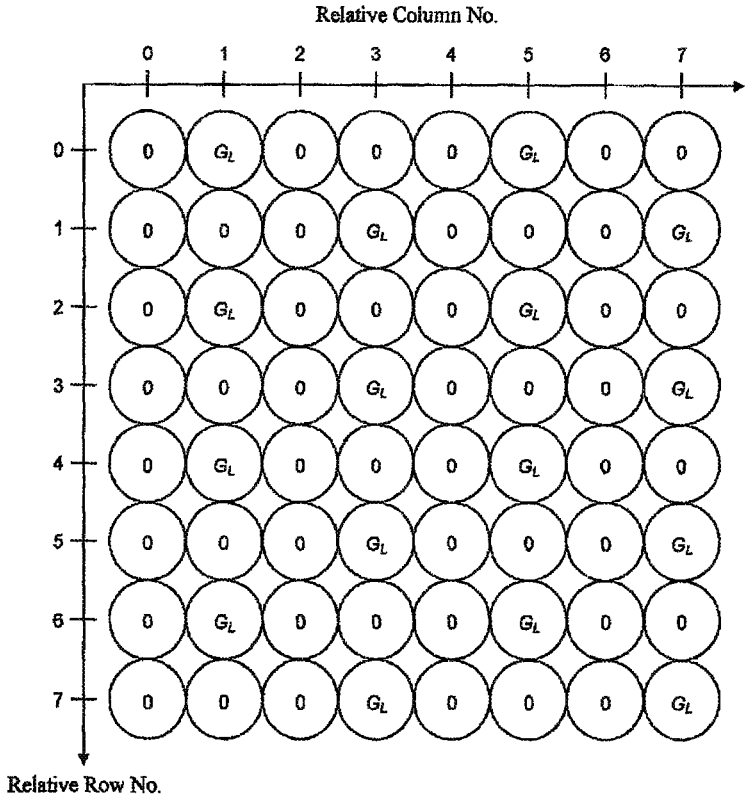
Figure 13C:
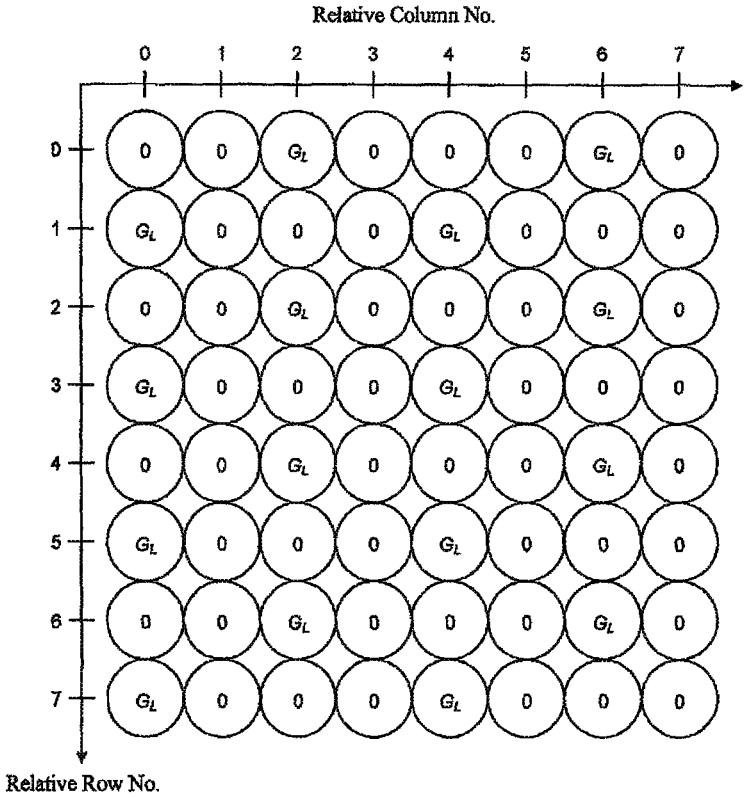
Figure 13D:
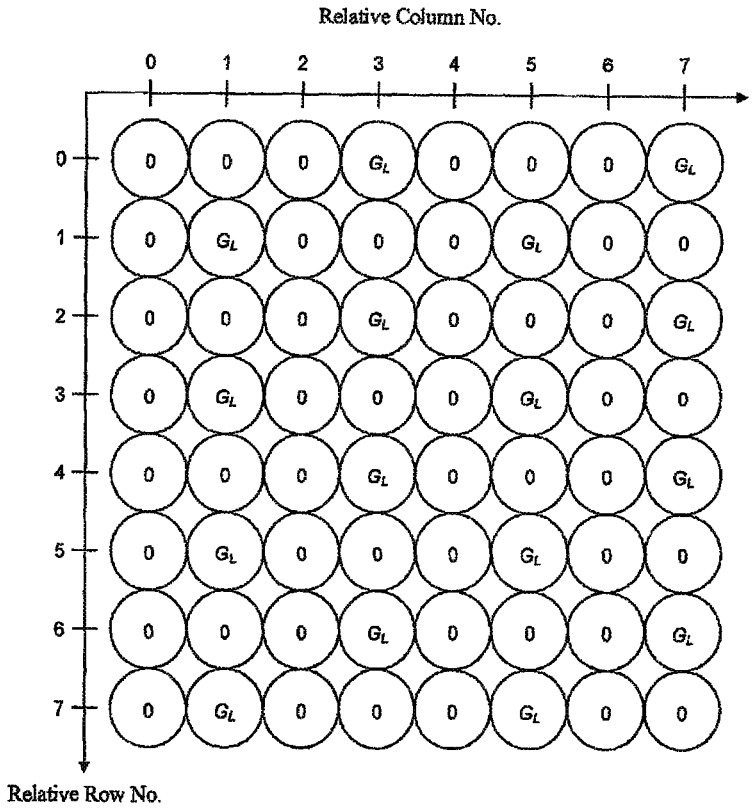

Take an LED display as an example, and let K=8, N=12, and M=10. In this case, the number of scan operations $S=2^{(N-M)}=4$, $G_H=G[11:2]$, $G_L=G[1:0]$. According to a further embodiment of the present disclosure, the scan data can be derived in a further permutation and superposition manner. For example, in a 1st scan operation, a pixel positioned at row 0, column 0 and a pixel positioned at row 1, column 2 have their respective scan data with a superposition value $X_1=G_L$, while other pixels have their respective scan data with a superposition value $X_1=0$, as shown in FIG. 12A; in a 2nd scan operation, a pixel positioned at row 0, column 1 and a pixel positioned at row 1, column 3 have their respective scan data with a superposition value $X_2=G_L$, while other pixels have their respective scan data with a superposition value $X_2=0$, as shown in FIG. 12B; in a 3rd scan operation, a pixel positioned at row 0, column 2 and a pixel positioned at row 1, column 0 have their respective scan data with a superposition value $X_3=G_L$, while other pixels have their respective scan data with a superposition value $X_3=0$, as shown in FIG. 12C; and in a 4th scan operation, a pixel positioned at row 0, column 3 and a pixel positioned at row 1, column 1 have their respective scan data with a superposition value $X_4=G_L$, while other pixels have their respective scan data with a superposition value $X_4=0$, as shown in FIG. 12D. When the 4 scan operations are completed, the process will repeat.

Figure 14:
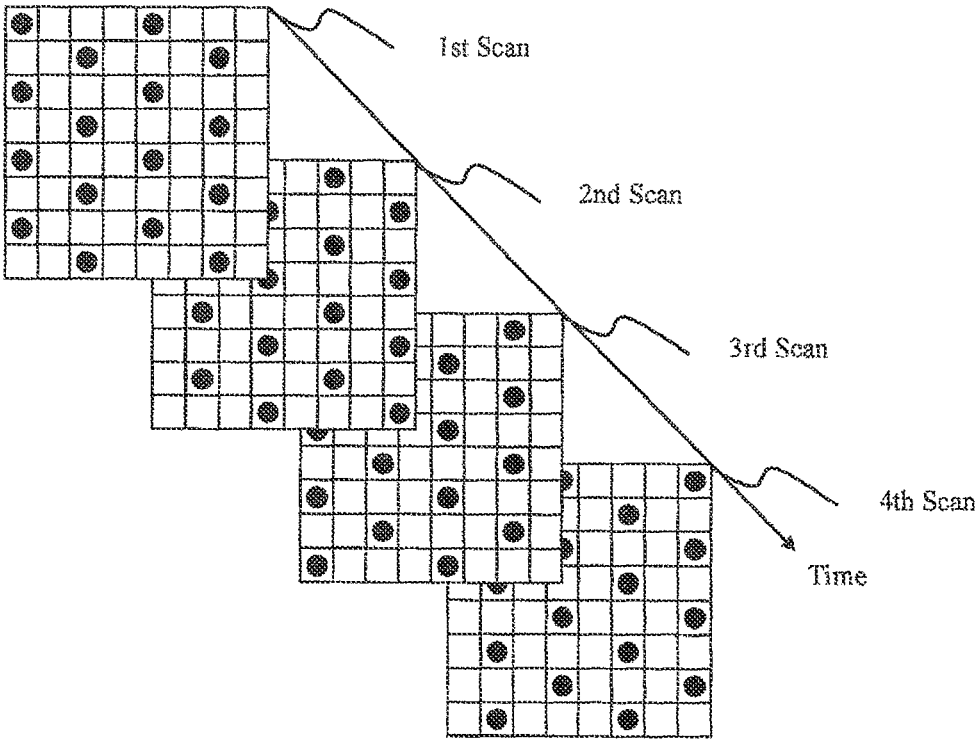
FIG. 14 shows the 4 scan operations shown in FIG. 13 in combination.

The above described process is extendable to more pixels of the display unit. FIG. 13 shows a superposition pattern for 8*8 pixels in 4 scan operations per display period. FIG. 14 shows the 4 scan operations shown in FIG. 13 in combination. It can be seen that a pixel has its scan data derived from superposition of the increment onto the reference in a scan operation, different from a scan operation in which a pixel directly adjacent thereto, whether vertically, horizontally, or diagonally, has its scan data derived from superposition of the increment onto the reference.

It is to be noted that the scan permutation is not limited to that described above. That is, the scan data can be outputted in any suitable permutation. For example, the following permutation is possible.

Figure 15:
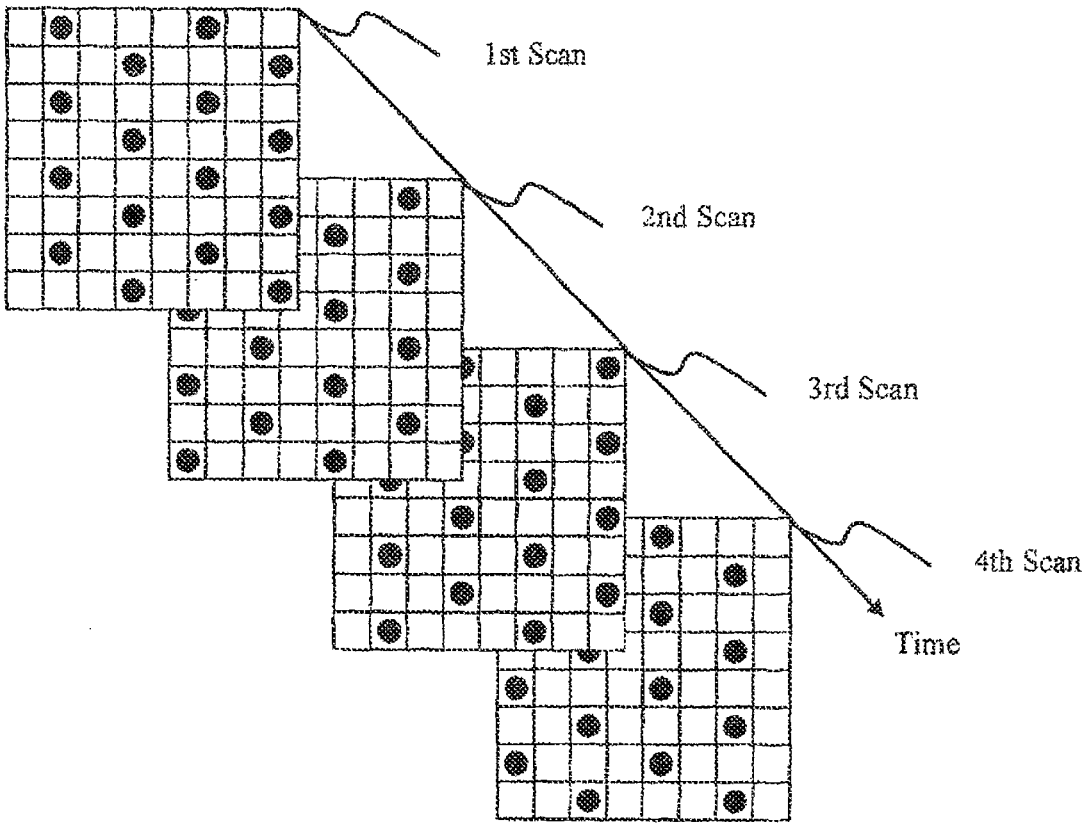
FIG. 15 shows a further combination of 4 scan operations in a case where K=8, M=10, N=12, G=11.

In a 1st scan operation, a pixel positioned at row 0, column 1 and a pixel positioned at row 1, column 3 have their respective scan data with a superposition value $X_1=G_L$, while other pixels have their respective scan data with a superposition value $X_1=0$, as shown in FIG. 12B; in a 2nd scan operation, a pixel positioned at row 0, column 2 and a pixel positioned at row 1, column 0 have their respective scan data with a superposition value $X_2=G_L$, while other pixels have their respective scan data with a superposition value $X_2=0$, as shown in FIG. 12C; in a 3rd scan operation, a pixel positioned at row 0, column 3 and a pixel positioned at row 1, column 1 have their respective scan data with a superposition value $X_3=G_L$, while other pixels have their respective scan data with a superposition value $X_3=0$, as shown in F IG. 12D; and in a 4th scan operation, a pixel positioned at row 0, column 0 and a pixel positioned at row 1, column 2 have their respective scan data with a superposition value $X_4=G_L$, while other pixels have their respective scan data with a superposition value $X_4=0$, as shown in FIG. 12A. When the 4 scan operations are completed, the process will repeat. FIG. 15 shows the 4 scan operations in this permutation in combination.

According to the principle of permutation and combination, it can be concluded that there can be twenty four (24) permutation patterns in total under this superposition pattern, referring to Table 1, in accordance with an embodiment. The resultant gray level presented on the display is a result of superposition of 4 pieces of scan data per display period, regardless of the permutation in which the scan data is outputted.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will be appreciated that various of the above-disclosed and other features and functions, or alternatives thereof, may be desirably combined into many other different systems/devices or applications. Various presently unforeseen or unanticipated alternatives, modifications, variations, or improvements therein may be subsequently made by those skilled in the art which are also intended to be encompassed by the following claims.

We claim:

1. A display driver circuitry with permutation and superposition gray-level control, including a gray-level controller, the gray-level controller comprising:

a permutation and superposition adder configured to separate N-bit gray-level data G, $g_N g_{N-1} \cdots g_1$, into M most significant bits, serving as a superposition reference $G_H$, $g_N g_{N-1} \cdots g_{(N-M+1)}$, and (N−M) least significant bits, serving as a superposition increment $G_L$, $g_{(N-M)} g_{(N-M-1)} \cdots g_1$, and to superpose incremental values $X_i$ onto $G_H$ to derive S pieces of scan data $G_i$, for S scan operations where i=1, 2, . . . , S, wherein $$G_i = G_H + X_i,$$

$$G = \sum_{i=1}^{S} G_i = S \cdot G_H + G_L,\ S = 2^{N-M},\ G_L = \sum_{i=1}^{S} X_i;$$

an overflow bit setting unit configured to set an overflow bit F=0 when $G_H+X_i \le (2^M-1)$ to indicate no overflow and then to keep $G_i=G_H+X_i$, and set F=1 when $G_H+X_i>(2^M-1)$ to indicate an overflow and then to set $G_i=2^M-1$; and an output unit configured to output S pieces of the scan data $G_i$, to display the S pieces of the scan data respectively in the S scan operations during a display period T, wherein each of the scan operations has a duration of T/S.

2. The display driver circuitry according to claim 1, wherein the pieces of scan data $G_i$, where i=1, 2, . . . , S, can be ordered in any permutation for the S scan operations.

3. The display driver circuitry according to claim 2, wherein in a case where S=2, the pieces of scan data $G_i$, have a permutation pattern of $G_1G_2$ or $G_2G_1$ for two scan operations.

4. The display driver circuitry according to claim 2, wherein in a case where S=4, the pieces of scan data $G_I$ have any one out of twenty four permutation patterns of $G_1$, $G_2$, $G_3$, and $G_4$ for four scan operations.

5. The display driver circuitry according to claim 1, wherein the pieces of scan data $G_i$, where i=1, 2, . . . , S, have any superposition pattern out of 0-order superposition, 1-order superposition, . . . , n-order superposition, . . . , and $G_L$-order superposition, where $0 \le n \le G_L$, wherein n-order superposition indicates that n terms out of $X_i$, are non-zero, and the remaining (S−n) terms are zero.

6. The display driver circuitry according to claim 2, wherein the pieces of scan data $G_i$, where i=1, 2, . . . , S, have any superposition pattern out of 0-order superposition, 1-order superposition, . . . , n-order superposition, . . . , and $G_L$-order superposition, where $0 \le n \le G_L$, wherein n-order superposition indicates that n terms out of $X_i$,are non-zero, and the remaining (S−n) terms are zero.

7. The display driver circuitry according to claim 1, wherein each pixel of a display has only one term out of its corresponding incremental values $X_i$, where i=1, 2, . . . , S, is $G_L$, while the remaining terms are zero.

8. The display driver circuitry according to claim 7, wherein pixels directly adjacent, whether vertically, horizontally, or diagonally, to the pixel whose incremental value $X_i$ is $G_L$ have their respective incremental values $X_i$ as zero.

9. The display driver circuitry according to claim 8, wherein in a case where S=4, in a first scan operation, a pixel positioned at row m, column n has its incremental value $X_1$ be $G_L$, pixels at row m, columns n+1, n+2, and n+3 have their respective incremental values $X_1$ be 0, a pixel positioned at row m+1, column n+2 has its incremental value $X_1$ be $G_L$, and pixels at row m+1, columns n, n+1, and n+3 have their respective incremental values $X_1$ be 0;

in a second scan operation, the pixel positioned at row m, column n+1 has its incremental value $X_2$ be $G_L$, the pixels at row m, columns n, n+2, and n+3 have their respective incremental values $X_2$ be 0, the pixel positioned at row m+1, column n+3 has its incremental value $X_2$ be $G_L$, and the pixels at row m+1, columns n, n+1, and n+2 have their respective incremental values $X_2$ be 0;

in a third scan operation, the pixel positioned at row m, column n+2 has its incremental value $X_3$ be $G_L$, the pixels at row m, columns n, n+1, and n+3 have their respective incremental values $X_3$ be 0, the pixel positioned at row m+1, column n has its incremental value $X_3$ be $G_L$, and the pixels at row m+1, columns n+1, n+2, and n+3 have their respective incremental values $X_3$ be 0; and in a fourth scan operation, the pixel positioned at row m, column n+3 has its incremental value $X_4$ be $G_L$, the pixels at row m, columns n, n+1, and n+2have their respective incremental values $X_4$ be 0, the pixel positioned at row m+1, column n+1 has its incremental value $X_4$ be $G_L$, and the pixels at row m+1, columns n, n+2, and n+3 have their respective incremental values $X_4$ be 0, wherein m and n are nonnegative integers.

10. The display driver circuitry according to claim 9, wherein the four scan operations can be ordered in any permutation.

11. The display driver circuitry according to claim 1, wherein the gray-level controller further comprises:

a nonlinear transform unit configured to conduct nonlinear transform on K-bit original data D to derive the N-bit gray-level data G according to equation (2):

$$G=C\cdot D^r \quad (2),$$

where C denotes a proportional constant and r denotes a nonlinear transform coefficient, $2.2 \le r \le 2.9$ and C=1.

12. The display driver circuitry according to claim 11, wherein the nonlinear transform unit comprises a nonlinear transform look-up table stored therein, which stores results of the nonlinear transform on all pieces of the K-bit original data in a one-to-one correspondence sequentially in addresses $0\text{-}2^K-1$.

13. A method of driving a display with permutation and superposition gray-level control, comprising:

separating N-bit gray-level data G, $g_N g_{N-1} \ldots g_1$, into M most significant bits, serving as a superposition reference $G_H$, $g_N g_{N-1} \ldots g_{(N-M+1)}$ and (N−M) least significant bits, serving as a superposition increment $G_L$, $g_{(N-M)} g_{(N-M-1)} \ldots g_1$, and superposing incremental values $X_i$ onto $G_H$ to derive S pieces of scan data $G_i$ for S scan operations where i=1, 2, . . . , S, wherein $$G_i = G_H + X_i,$$

$$G = \sum_{i=1}^{S} G_i = S \cdot G_H + G_L,\ S = 2^{N-M},\ G_L = \sum_{i=1}^{S} X_i;$$

setting an overflow bit F=0 when $G_H+X_i \le (2^M-1)$ to indicate no overflow and then to keep $G_i=G_H+X_i$, and setting F=1 when $G_H+X_i>(2^M-1)$ to indicate an overflow and then to set $G_i=2^M-1$; and outputting S pieces of the scan data $G_i$, to display the S pieces of the scan data respectively in the S scan operations during a display period T, wherein each of the scan operations has a duration of T/S.

14. The method according to claim 13, further comprising ordering the pieces of scan data $G_i$, where i=1, 2, . . . , S, in any permutation for the S scan operations.

15. The method according to claim 14, wherein in a case where S=2, the pieces of scan data $G_i$ have a permutation pattern of $G_1G_2$ or $G_2G_1$ for two scan operations.

16. The method according to claim 14, wherein in a case where S=4, the pieces of scan data $G_i$ have any one out of 24 permutation patterns of $G_1$, $G_2$, $G_3$, and $G_4$ for four scan operations.

17. The method according to claim 13, wherein the pieces of scan data $G_i$, where i=1, 2, . . . , S, have any superposition pattern out of 0-order superposition, 1-order superposition, . . . , n-order superposition, . . . , and $G_L$-order superposition, where $0 \le n \le G_L$, wherein n-order superposition indicates that n terms out of $X_i$ are non-zero, and the remaining (S−n) terms are zero.

18. The method according to claim 14, wherein the pieces of scan data $G_i$, where i=1, 2, . . . , S, have any superposition pattern out of 0-order superposition, 1-order superposition, . . . , n-order superposition, . . . , and $G_L$-order superposition, where $0 \le n \le G_L$, wherein n-order superposition indicates that n terms out of $X_i$ are non-zero, and the remaining (S−n) terms are zero.

19. The method according to claim 13, wherein each pixel of the display has only one term out of its corresponding incremental values $X_i$, where i=1, 2, . . . , S, be $G_L$, while the remaining terms are zero, and wherein the method further comprises:

during a single scan operation, among every S pixels in a row, having only one pixel that has its incremental value $X_i$ be $G_L$, while the remaining (S−1) pixel(s) have their respective incremental value(s) $X_i$ as zero.

20. The method according to claim 19, wherein during a single scan operation, pixels directly adjacent, whether vertically, horizontally, or diagonally, to the pixel whose incremental value $X_i$ is $G_L$ have their respective incremental values $X_i$ be zero.

21. The method according to claim 20, wherein in a case where S=4, in a first scan operation, a pixel positioned at row m, column n has its incremental value $X_1$ be $G_L$, pixels at row m, columns n+1, n+2, and n+3 have their respective incremental values $X_1$ be 0, a pixel positioned at row m+1, column n+2has its incremental value $X_1$ be $G_L$, and pixels at row m+1, columns n, n+1, and n+3 have their respective incremental values $X_1$ be 0;

in a second scan operation, the pixel positioned at row m, column n+1has its incremental value $X_2$ be $G_L$, the pixels at row m, columns n, n+2, and n+3 have their respective incremental values $X_2$ be 0, the pixel positioned at row m+1, column n+3 has its incremental value $X_2$ be $G_L$, and the pixels at row m+1, columns n, n+1, and n+2have their respective incremental values $X_2$ be 0;

in a third scan operation, the pixel positioned at row m, column n+2has its incremental value $X_3$ be $G_L$, the pixels at row m, columns n, n+1, and n+3 have their respective incremental values $X_3$ be 0, the pixel positioned at row m+1, column n has its incremental value $X_3$ be $G_L$, and the pixels at row m+1, columns n+1, n+2, and n+3 have their respective incremental values $X_3$ be 0; and in a fourth scan operation, the pixel positioned at row m, column n+3 has its incremental value $X_4$ be $G_L$, the pixels at row m, columns n, n+1, and n+2 have their respective incremental values $X_4$ be 0, the pixel positioned at row m+1, column n+1 has its incremental value $X_4$ be $G_L$, and the pixels at row m+1, columns n, n+2, and n+3 have their respective incremental values $X_4$ be 0, wherein m and n are nonnegative integers.

22. The method according to claim 21, wherein the four scan operations can be ordered in any permutation.

23. The method according to claim 13, further comprising:

conducting nonlinear transform on K-bit original data D to derive the N-bit gray-level data G according to equation (2):

$$G=C\cdot D^r \quad (2),$$

where C denotes a proportional constant and r denotes a nonlinear transform coefficient, $2.2 \le r \le 2.9$ and C=1.

24. The method according to claim 23, further comprising:

storing, in a nonlinear transform look-up table, results of the nonlinear transform on all pieces of the K-bit original data in a one-to-one correspondence sequentially in addresses $0\text{-}2^K-1$.

* * * * *